United States Patent [19]

Maiuccoro et al.

[11] Patent Number: 5,010,699

[45] Date of Patent: Apr. 30, 1991

[54] MODULAR STAIR SUPPORT FIXTURES HAVING ALTERNATE PACKAGING USAGE

[75] Inventors: John V. Maiuccoro, Albany; John Gardenier, Guilderland, both of N.Y.

[73] Assignee: Saratoga Spa & Bath, Latham, N.Y.

[21] Appl. No.: 521,328

[22] Filed: May 9, 1990

[51] Int. Cl.[5] ..... E02D 27/00

[52] U.S. Cl. ..... 52/169.8; 52/183; 52/184; 182/93

[58] Field of Search ..... 52/182, 191, 183, 184, 52/169.8; 182/97, 194, 93

[56] References Cited

U.S. PATENT DOCUMENTS

| | | | |
|---|---|---|---|
| 3,848,378 | 11/1974 | Witte | 52/184 |
| 4,015,687 | 4/1977 | Dean | 52/191 X |
| 4,106,591 | 8/1978 | Cohen et al. | 52/182 X |
| 4,589,237 | 5/1986 | Dahowski | 52/169.7 |
| 4,757,653 | 7/1988 | Anderholm | 52/184 X |
| 4,866,894 | 9/1989 | Brown | 52/182 |
| 4,873,802 | 10/1989 | Dahowski | 52/184 |

*Primary Examiner*—David A. Scherbel
*Assistant Examiner*—Lan Mai
*Attorney, Agent, or Firm*—Schmeiser, Morelle & Watts

[57] ABSTRACT

An improved fixture system for mounting a stair support truss to a module stair unit. U channel fixtures are secured to the collar and to the front base riser of a modular set of stairs. These fixtures are used to attach a truss support to the stair module; and, the truss support is itself modified to project upward a plurality of plane tenon supports so that they will engage U channel stair tread braces. In preparation for packaging and subsequent transportation, the collar and buttress fixtures are used as hard mounting points for bundles of the remaining stair support elements which are then banded thereto.

5 Claims, 4 Drawing Sheets

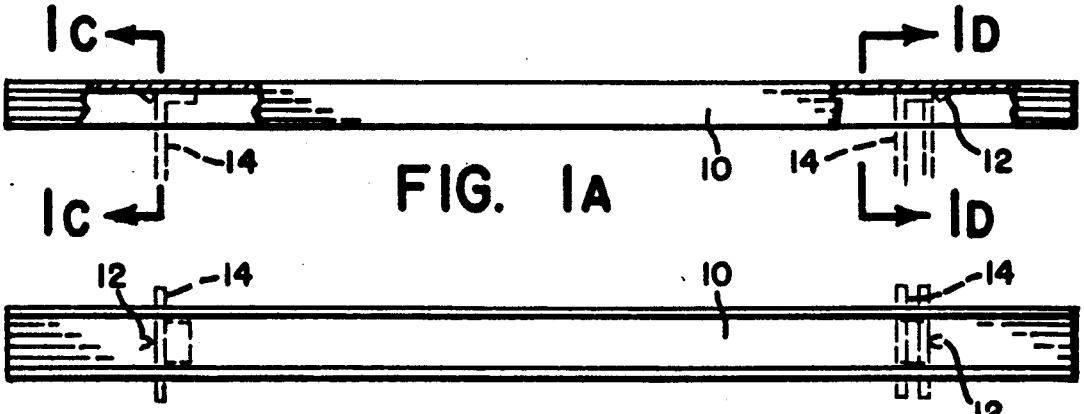
FIG. 1A
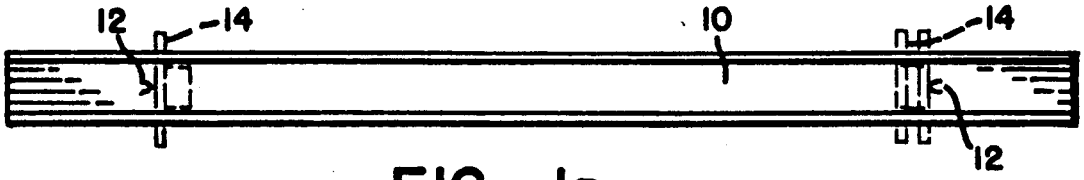
FIG. 1B
FIG. 1C
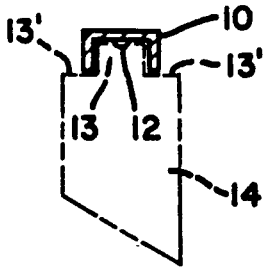
FIG. 1D
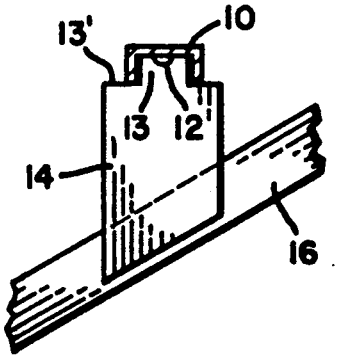
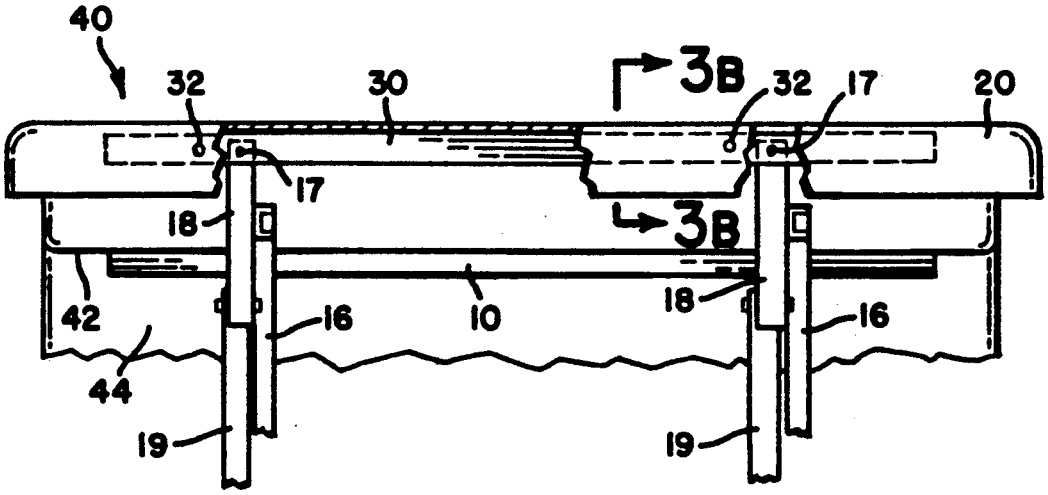
FIG. 3A

MODULAR STAIR SUPPORT FIXTURES HAVING ALTERNATE PACKAGING USAGE

BACKGROUND OF THE INVENTION

1. Field of the Invention

This invention relates to support fixtures for attachment to supporting structures that are used with modular stair ensembles such as prefabricated swimming pool stairs. The invention, in particular, is a method and apparatus for attaching a fixture to a truss-type support structure that is adapted to underlie and support a prefabricated series of connected steps; and, after installation into the module, but before the module is installed for pool usage, the fixture is used for the attachment thereto of the truss-support structure pieces so that the entire ensemble, stair module-truss assembly may be packaged and shipped as a singular unit.

2. Discussion of Prior Art

The most relevant art that may be discussed with our instant invention is contained and disclosed in U.S. Pat. application 479,652, filed on Feb. 14, 1990 for our STAIR SUPPORT SYSTEM. The stair support system is an invention for supporting a prefabricated series of connected steps that makes use of a truss-type assemblage of members. The system includes a pair of pivotally mounted, adjustable length, outer support legs. Pivotally and removably connected to the outer legs is a pair of stair support members, often termed stringers. Each stringer is anchored, i.e. fastened, at its bottom end to a prefabricated structure located at the base riser. For the purposes of the instant invention this area of structure below the steps, that is, appended to the first stair riser at its back surface, is termed a forward or front buttress. The stringers include a series of upwardly extending vertical risers which contact channel supports that are located beneath each individual step, but not necessarily fastened to a step or steps. This technique is used for supporting a plurality of steps as though it were a singular unit and thus, can be said to effect support of the module.

In the aforementioned earlier patent application, we discussed how the stair support system is designed to be easily fastened to or disengaged from the pool or tank unit in order to facilitate transport of the unit and the installation of the supporting structure. At that time, it was not expedient to explain a fixture subsystem that had the dual function of providing not only an anchoring/fastening means for the attachment thereto of the truss-type support system, but could also be used during the shipping or transportation mode for the bundling and attachment thereto of remaining truss support structures. Thus, the modular unit, principally the stair module, could be shipped conveniently and, to the maximum extent possible, integrally.

Before detailing the instant invention, it is proper to summarize the stair support system that is fixed to the instant invention (the invention hereinafter termed the "fixture" apparatus), so that the reader will be familiar with the lexicon used in this disclosure. In a stair module of the preformed type, generally constructed of plastic (ABS, generally) or fiberglass, a reinforcement structure is provided at the base of the module at the backside of the first riser. This reinforcement takes the form of a bolted-on U channel with a number of (also) bolted-on angle iron sections or tabs. The entire ensemble is termed the "front buttress". Ascending from the front buttress at an angle of approximately 45° is one or more stringers comprising generally U channel and termed the "truss section". At the rear of the module, the stringer is fixed to an essentially vertical U channel termed an "outside leg". When installed, the outside leg is generally fixed firmly in concrete, as is the lower portion of the front buttress. The top of the outside leg rises to a point where it is fixed to the top of the stair module unit, generally proximate the topmost, rear surface. In the instant invention, and with the stair module of the instant inventors, the stair module is afforded an inverted U shaped collar that is commonly, but erroneously, called "coping". At this point it is important to make a distinction between the module "collar" which receives a portion of the instant fixture apparatus and the pool coping. The former is part of the stair module proper, while the latter is properly part of the pool decking. As it will be readily surmised, the rear end of the collar is conterminous with pool decking or coping, but distinct therefrom. The collar rigidizing or strengthening fixture is a section of U channel that is bolted to the back portion of the collar. It underlies the modular collar and receives inside its channel the outside leg which is securely abutted to and bolted to the U channel strengthening fixture. Finally, along the stringer, at various locations subtending the stair treads, are vertical supports which are firmly affixed to the stringer by conventional means such as bolting or welding. The supports are disposed either under the stair tread, contacting the underside thereof, or in contact with other tread strengthening means such as commonplace structural members known to those familiar with the art.

SUMMARY OF THE INVENTION

The instant invention is a stair support fixture system that comprises structural reinforcing members that accept the stair support system disclosed in our U.S. Pat. application No. 479,652, filed Feb. 14, 1990. The principal members of the stair support system that are attached to the fixtures of the instant invention are: the outside leg, which is fitted into the modular stair collar reinforcing channel fixture; and the stringer depending therefrom, which is fitted to the front buttress of the stair module. The collar reinforcement channel and the front buttress reinforcement means comprise U channels that are bolted to the rear of the module collar and the rear of the first riser, respectively. Minor improvements are afforded in the instant invention, namely the reconfiguration of the supports which extend from the stringer, and in the U channels which underlie the stair treads. These improvements comprise, essentially, plane tenon-shaped vertical supports and movable, non-attached U channels that are mortise-shaped to straddle the tenon shoulders of the vertical supports. During conventional usage of the invention, a pair of truss-type support units are used and at least two tenon vertical supports will be inserted into a single stair tread U channel (mortise) to effect an equally balanced under-tread support unit. Another minor improvement is the use of detents which protrude slightly inward of the mortises in the U channel reinforcement element. In operation, these detents (often called "tabs") are placed to the outside of the tenon head, thus immobilizing the U channel and preventing any side-to-side sliding once it is installed between the underside of the stair tread and the assembled truss network.

The second function of the fixture apparatus is realized after fabrication of the unit but before final packaging for shipment. A portion of the outside leg is folded into the collar reinforcement fixture and the remaining outside leg extensions, or pool supporting channelwork, are bundled and lashed to the collar fixture. Finally, the stringers and the under-tread U channels are bundled and compactly lashed to the front buttress U channel so that a number of the modules (upwards of ten) with lashed truss support systems can be stacked or nested within each other on shipping pallets.

BRIEF DESCRIPTION OF THE DRAWINGS

Of the Drawings:

FIGS. 1A and 1B are side elevation and bottom plan views of a step respectively;

FIGS. 1C and 1D are, respectively, an end sectional view of FIG. 1A and a side elevation of a vertical support engaging the apparatus of FIG. 1C;

FIG. 3A is a sectionalized rear elevation of the collar fixture;

DETAILED DESCRIPTION OF THE PREFERRED EMBODIMENT

Figure 2:
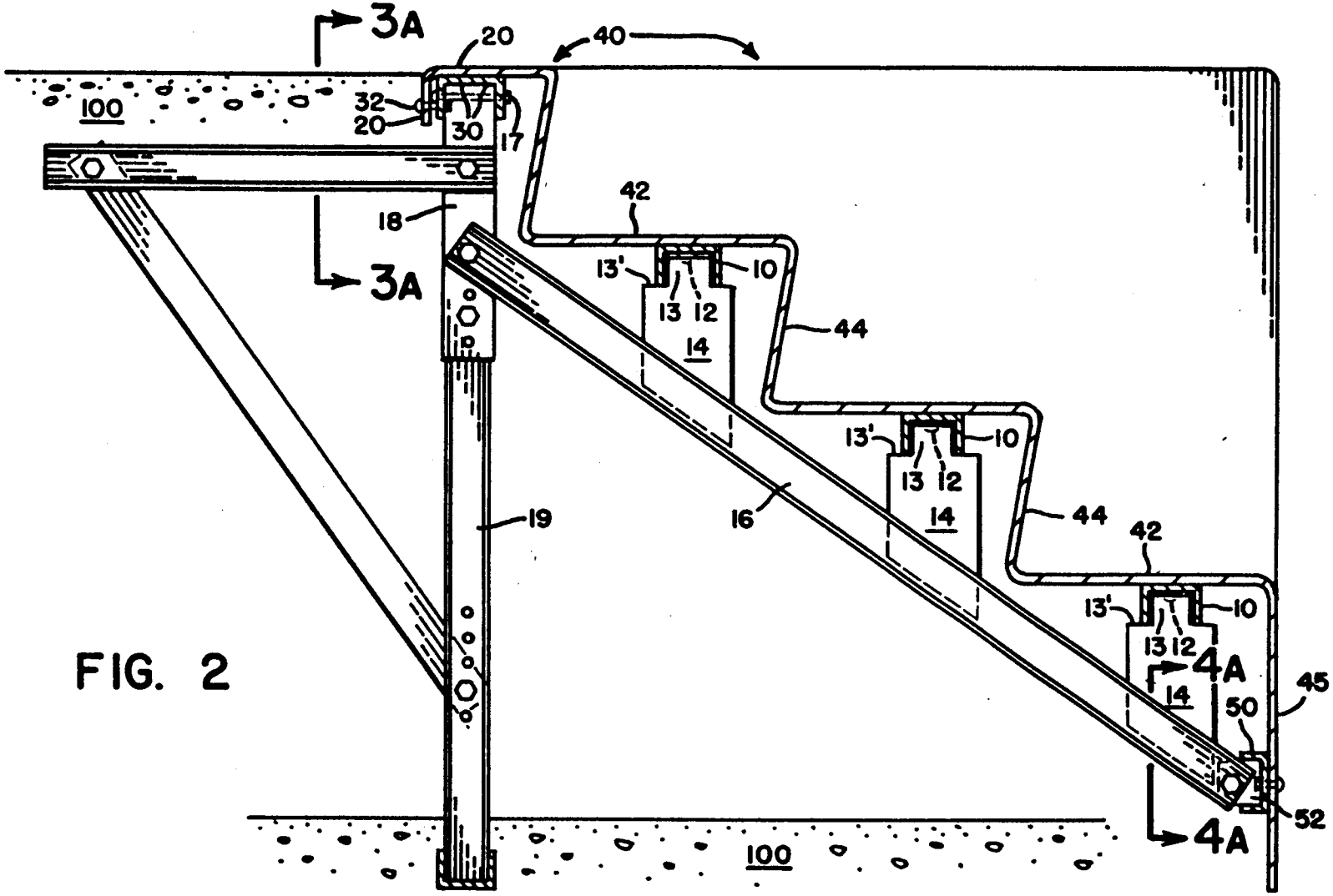
FIG. 2 is a side elevation illustrating a singular truss installation.

In the first two figures we shall review the parts that are disclosed in our stair support system and, where appropriate, include the improvements that will be disclosed and hereinafter claimed. In the side and bottom views of FIGS. 1A and 1B there are disclosed the U channels 10 that are used most effectively throughout the instant apparatus. In the cases of FIGS. 1A and 1B, the U channels disclosed are those that are utilized for under-stair tread support and are thus configured with tabs 12 which project downward, internal of the U channel. It should be noted that, in this instance, the tabs are effected by die, that is, they are hemispherical punchings that are bent or tabbed inward of the U channel with the tip or the detent positioned so as to engage a head end 13 of tenon 14. It is this engagement, at each side of the U channel 10, that precludes side-to-side movement of the channel after it is installed with the stair support system. It should be noted that when abutting pieces such as tenons 14 into mortise-channels 10 are shown, a separation of the parts may be clearly discerned. This is done for the sake of clarity and should not be read as a stand-apart or spaced relationship, since it is the function of the truss supporting network to firmly engage other portions of the pool stair module system. Continuing now in FIGS. 1C and 1D, the reader will note that the section of U channel 10 is indeed mortise-shaped and receives the head 13 of tenon 14. As stated earlier, side-to-side motion is precluded by the use of two spaced-apart tabs 12, which are clearly disclosed in both figures. In FIG. 1D, the tenon-shaped vertical support is seen rising from stringer 16 to engage the mortise shape of U channel 10.

FIG. 2 presents an overall side elevation disclosing the pool stair module 40 in partial cross section, the cross section detailing the collar 20, a series of risers 44 interspersed with treads 42 which terminate at the lower (front) portion at base riser 45, and the entire unit's foundation in concrete 100. Pool decking 100 is also represented as a concrete-like matrix. The fixtures of the instant invention are realized at U channel reinforcements 30 and 50, located in the collar 20 and at the (buttress) first riser 45, respectively. Depending from the collar fixture 30 is outer leg 18 with its extension 19; and attached to the front buttress 50 is angle tab 52, to which is bolted stringer 16. Stringer 16 is then bolted to outer leg 18 and its vertical supports 14 are brought into registry with the stair reinforcement U channels 10. It can be seen from this view that the head portions 13 of tenon supports 14 seat snugly within the mortise-like receiving U channels which afford under-tread support. Those of ordinary skill will readily recognize the fact that U channel 10 tabs 12 may be positioned either inside or outside vertical supports 14, provided that on the outside stringers, the placement of the tabs with relation to the tenon 14 heads 13 must be consistent, that is, either both tabs outside the tenon heads or both inside the heads. The fit of the tenon heads 13 into the mortise-like U channels 10 must be snug, either at the top portions (shown here with a slight spacing) or at the shoulders 13′ of the tenon supports. This will minimize flexure of the stair treads during usage. Likewise, it may be readily seen that the outside of the vertical leg 18 closely engages the inside surface of U channel fixture 30 and that its bolting apparatus 17 merely prevents side-to-side motion. The weight of the collar top surface is brought to bear directlY on the top of outside leg 18. U channel 30 fixture is secured to the collar 20 by bolt 32 and nut 33 (not shown). This fixture and its securement to the collar 20 will be further detailed hereinafter.

Figure 3B:
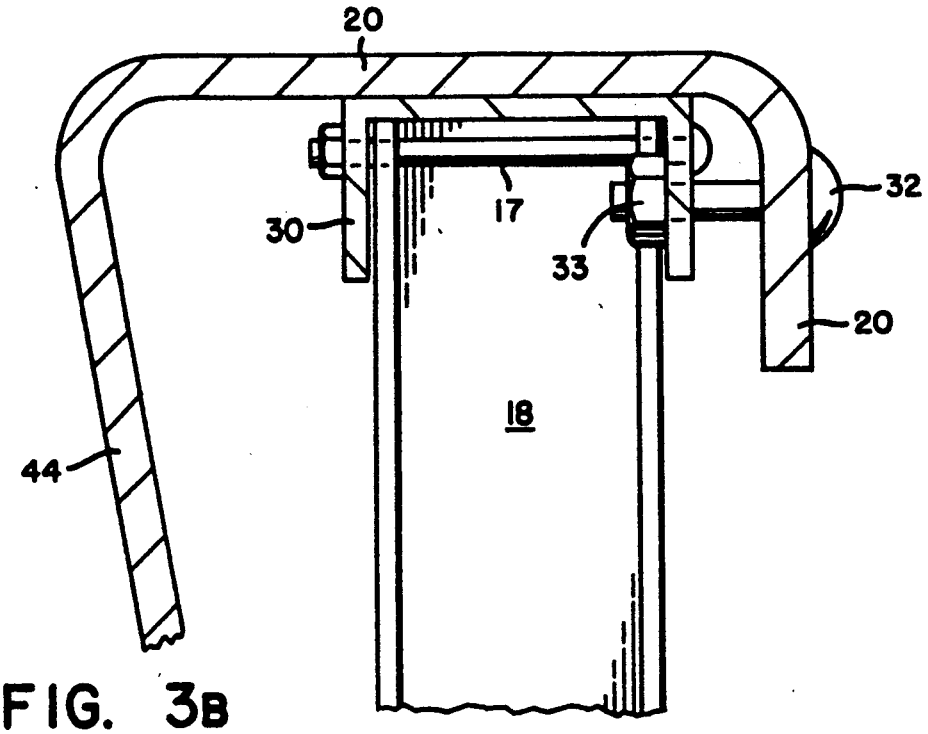
FIG. 3B is a partial side elevation of FIG. 3A taken at 3B—3B.

Referring more particularly now to FIGS. 3A and 3B, there is shown, first, a partial rear elevation of a paired truss support network. A left and right truss are affixed at the top of the outside legs 18 to the collar fixture 30, which is bolted into the collar 20 with bolts 32. The outside legs 18, with extensions 19, are seen to depend rigidly from collar fixture 30 and are attached thereto by bolt units 17. Risers 44 are clearly seen from the backside of the module 40; and treads 42, although barely defined, are distinguished clearly by the presence of tread 42 support U channel 10. Supporting the U channel 10 are vertical supports 14 (not shown) which rise from stringers 16. The reader will also notice that stringers 16 appear to face the same side of this module and, as those skilled in this art will readily perceive, the left and right truss networks are identical. This identity in individual truss networks lends an added dimension of both utility and economy to the instant invention.

In FIG. 3B, there is shown a sectional detail of the outside leg 18 and the attachment of fixture 30 within the collar 20. The collar 20 is seen appended to the last riser 44 and, at first blush, appears to be a beginning of pool coping. Collar fixture 30 is held rigidly inside the collar 20 by nut 33 and bolt 32. In actual practice, the proximity of fixture 30 to the bolt head 32 portion of collar 20 is much closer than that illustrated herein. Finally, in this cross section, it may be seen that outside leg 18 resides firmly within the mortise-like U channel that comprises collar fixture 30 and is further held therein by nut and bolt assembly 17.

Figure 4A:
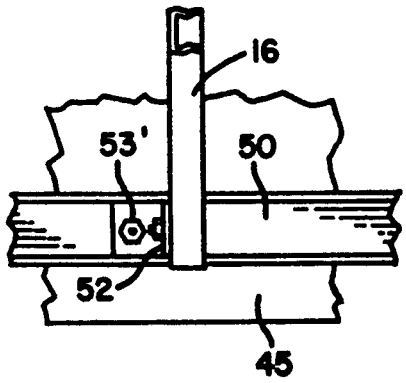
FIG. 4A is a partial rear elevation of FIG. 2 taken at 4A—4A.
Figure 4B:
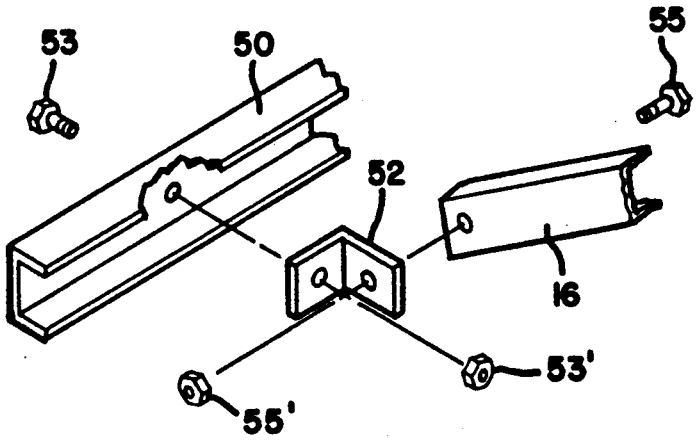
FIG. 4B is a detailed exploded view of the stringer-front buttress connection.

Having described the collar fixture, the reader's attention is now directed to FIG. 4A wherein there is disclosed a section of the front buttress 50 comprising a U channel such as used in the collar fixture, with the additional apparatus of an angle brace 52 which is used to accommodate the coupling thereto of stringer 16. It will be noted that buttress 50 is bolted to module base riser 45 a few inches above the base margin of the front base riser. Further detail of the front buttress is seen in FIG. 4B, an exploded partial view of the connection mechanism. Here, it can be readily seen that the U channel comprising the front buttress 50 is secured to riser 45 (not shown) by bolt 53 and nut 53'. The bolt and nut arrangement 53/53' also secures therewith right angle tab 52, which is a section of an ordinary right angle. Then, the bottom end of stringer 16 is secured to the projecting leaf of tab 52. Securement is by bolt 55 and nut 55'.

Figure 5A:
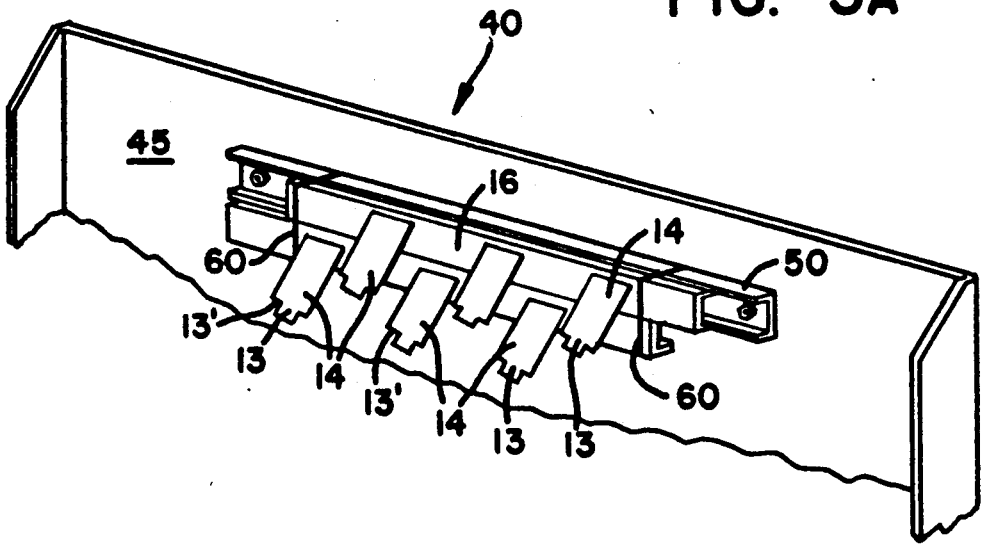
FIG. 5A is an isometric illustration of the stringer and partial channel supporting network lashed to the front buttress in the shipping modality.
Figure 5B:
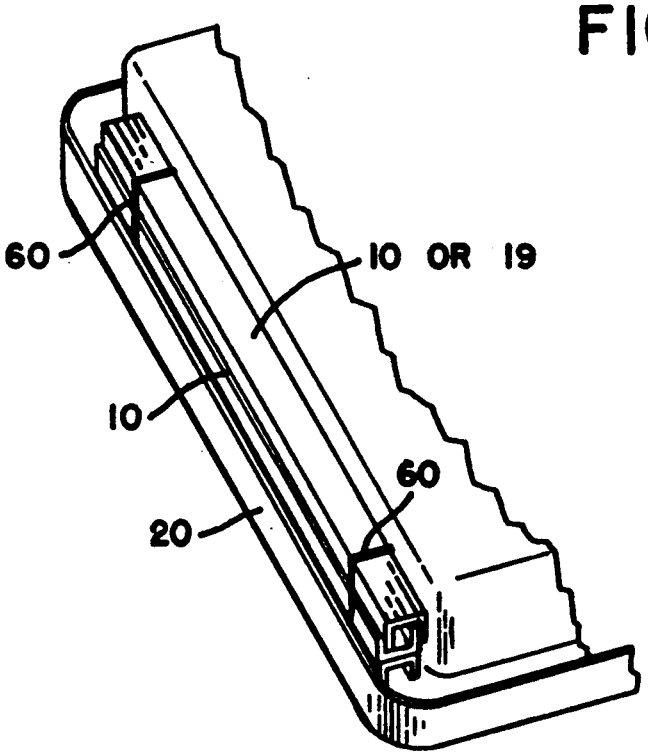
FIG. 5B is an isometric illustration of the collar fixture to which is lashed the remaining U channel supporting structure.

Final to the aforementioned improvement is the use (second function) of the instant invention in securement of the remaining portions of the stair support structure to the collar 30 and front buttress 50 fixtures. Reference to FIGS. 5A and 5B shall disclose succinctly how this invention affords the producer of the stair support system a novel means for compactly packaging and transporting the entire ensemble 40. In FIG. 5A, in an upside-down configuration, the front buttress 50 is disclosed bolted to the base riser 45. Secured to the buttress 50 by plastic bands 60 passed between U channel fixtures and module 40 surfaces are two stringers 16 (bearing the vertical support tenons 14) stacked in an interdigitated array. At FIG. 5B, remaining U channel tread supports 10 or leg extensions 19 are stacked by interfitting the legs of the U channels and lashing the entire grouping to collar fixture 30 (not clearly shown herein). Thus, all of the structure comprising various U channels and plane tenon supports 14 are closely interfitted and bundled to the rigidly bolted buttress and collar fixtures.

Those of ordinary skill will, after minimum practice with the invention, be able to contrive many varied arrangements for the remaining stair support structure so that it might be conveniently lashed to the buttress 50 and collar 30 fixtures in order to effect a convenient and economical shipping modality for the pool stair module and stair support structure ensemble 40. Set up time in situ will be greatly minimized by use of the fold-out outside leg members 18, stringer 16 fixtures to the front buttress 50 and, especially, the mortise-tenon application for acquiring under-step tread support interlocked with the plane vertical support rising off the stringer as herein disclosed. Variations may be practiced without departing from the spirit of the invention, but while limited by the claims as they now appear.

What is claimed is:

1. In a stair support system comprising a preformed stair module and including a folding outer leg having top and bottom ends with bottom end securing means and top end fastening means for connection to a stair module top end fixing means, a stringer having a top end removably connected to the outer leg, adapted to underlie steps of said module and removably connectable by bottom end fastening means to a buttress riser of said module, and a plurality of stair support members each of which has a first support end connected to the stringer and a second support end adapted to underlie and support a normally horizontal step structural element, an improvement comprising:

a first rigid brace means disposed in a collar means of said module, said first brace means further comprising mortise means therewithin and adapted to receive an outer leg therein and directly contact an end of said outer leg;

a second rigid brace means disposed on the module at the backside of said buttress riser of said module and comprising a front buttress, said front buttress adapted for fastening thereto said stringer; and said plurality of support members each defining at each said second support end thereof a plane tenon.

2. The invention of claim 1 further comprising a plurality of mortise means- containing rigid elongate braces, each said elongate brace adapted for disposition beneath a step tread of said module and adapted to receive into said mortise means thereof at least one of said plane tenons.

3. The invention of claim 2 wherein each of said mortise means-containing rigid, elongate braces is a U channel brace and further, each includes two detents projecting inward of and from the base of said brace.

4. The invention of claim 3 wherein said first and second rigid braces are fixidly disposed in said collar means and on said buttress riser, respectively, thereby providing fixed hard mounts for attaching thereto, for packaging purposes, all other elements of said system.

5. The invention of claim 1 wherein said first and second rigid braces are U channel braces and said front buttress further defines one or more right angle tabs.

* * * * *